US005488739A

United States Patent [19]

Cardinal

[11] Patent Number: 5,488,739

[45] Date of Patent: Feb. 6, 1996

[54] HOCKEY GLOVE CONSTRUCTION

[75] Inventor: Gilles Cardinal, St-Luc, Canada

[73] Assignee: Itech Sport Products, Inc., Dollard des Ormeaux, Canada

[21] Appl. No.: 356,639

[22] Filed: Dec. 15, 1994

[51] Int. Cl.[6] ..... A41D 19/00; A41D 13/10

[52] U.S. Cl. ..... 2/161.1; 2/162; 2/163; 2/16

[58] Field of Search ..... 2/16, 19, 20, 159, 2/161.1, 162, 163, 167, 170, 160

[56] References Cited

U.S. PATENT DOCUMENTS

| | | | |
|---|---|---|---|
| 4,497,073 | 2/1985 | Deutsch | 2/16 |
| 4,930,162 | 6/1990 | Cote | 2/16 |
| 5,237,703 | 8/1993 | Brine et al. | 2/16 |
| 5,329,639 | 7/1994 | Aoki | 2/161.1 |

FOREIGN PATENT DOCUMENTS

| | | | |
|---|---|---|---|
| 630285 | 10/1961 | Canada | 2/162 |
| 2035717 | 8/1992 | Canada | 2/16 |

*Primary Examiner*—C. D. Crowder

*Assistant Examiner*—Michael A. Neas

*Attorney, Agent, or Firm*—Fisher & Associates

[57] ABSTRACT

A hockey glove comprising a hand protective section and a wrist protective section. The hand protective section has a palm portion, a thumb portion and finger portions interconnected by an inner fabric. An outer hand protective fabric structure is connected to the inner fabric and has a plurality of outer protective padded formations disposed over the hand portion, thumb portion and finger portions. The padded formations have an outer wear resistant cover. The padded formation disposed over each of the finger portions has at least two separated padded finger sections extending coextensively with each finger portion from an upper knuckle area of the finger portion to a finger ending. A flexible joint is defined at the upper knuckle area and between the two separated padded finger sections substantially at a mid-knuckle area of the finger portion. A narrow transverse flexible protective web of wear resistant material is secured in the joint areas to provide external protection at the joint areas when the finger portions are articulated to a clasped position by a wearer clasping the hand. The joints reduce pressure points in the hand protective section of the glove when a wearer's hand is clasped such as when gripping a hockey stick.

21 Claims, 4 Drawing Sheets

HOCKEY GLOVE CONSTRUCTION

TECHNICAL FIELD

The present invention relates to a hockey glove wherein the finger portions are provided with separated padded finger sections having an upper joint and a substantially mid-joint wherein a protective web of wear resistant material is secured in the joints to provide external protection at the joint areas which are open when the finger portions are articulated by a wearer clasping the hands. The glove also has an improved cuff structure.

BACKGROUND ART

Various hockey glove structures are known and and many of these present various problems to the wearer during the game of hockey. Because these gloves are constructed with heavy padding for protection, it is often difficult to have freedom of hand movement within the glove as the padding offers resistance to normal hand movement. In particular, the finger portions are heavily padded to protect the fingers which are more delicate, and when the hand is clasped this padding offers resistance and a certain pressure must be exerted by the hand and fingers to firmly grasp a hockey stick. Another problem with the construction of hockey gloves is that these gloves have a cuff portion which extends over the wrist area and such cuff restricts freedom of movement of the hand and arm when the hockey player assumes a certain position, such as during a "face-off" or whenever the elbow and the hand are articulated. A still further disadvantage of known hockey glove structures is that certain parts of the glove wear quite rapidly, such as the palm portion of the glove. These gloves therefore have a short life and do not provide the intended protection.

SUMMARY OF INVENTION

It is therefore a feature of the present invention to provide a hockey glove which substantially overcomes all of the above-mentioned disadvantages and which permits freer hand and arm movement by the wearer.

Another feature of the present invention is to provide a hockey glove wherein the padded finger portions are formed with joints which are protected by flexible protective webs so that when the hand is clasped protection is also provided in the open joint areas.

Another feature of the present invention is to provide a hockey glove having an adjustable inner cuff portion to permit adjustment of the size of the hand opening of the glove.

Another feature of the present invention is to provide a hockey glove having a palm portion formed with a Kevlar wear resistant material.

According to the above features, from a broad aspect, the present invention provides a hockey glove which is comprised of a hand protective section and a wrist protective section. The hand protective section has a palm portion, a thumb portion, and finger portions interconnected by an inner fabric. An outer hand protective fabric structure is connected to the inner fabric and has a plurality of outer protective padded formations disposed over the hand portion, thumb portion and finger portions. The padded formations have an outer wear resistant material covering. The padded formation disposed over each of the finger portions has at least two separated padded finger sections extending coextensively with each finger portion from an upper knuckle area of the finger portion to a finger ending. A flexible joint is defined at the upper knuckle area and between the two separated padded finger sections substantially at a mid-knuckle area of the finger portion. A narrow transverse flexible protective web of wear resistant material is secured in the joint areas to provide external protection at the joint areas when the finger portions are articulated to a clasped position by a wearer clasping the hand. The joints reduce pressure points in the hand protective section when a wearer's hand is clasped, such as when gripping a hockey stick.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
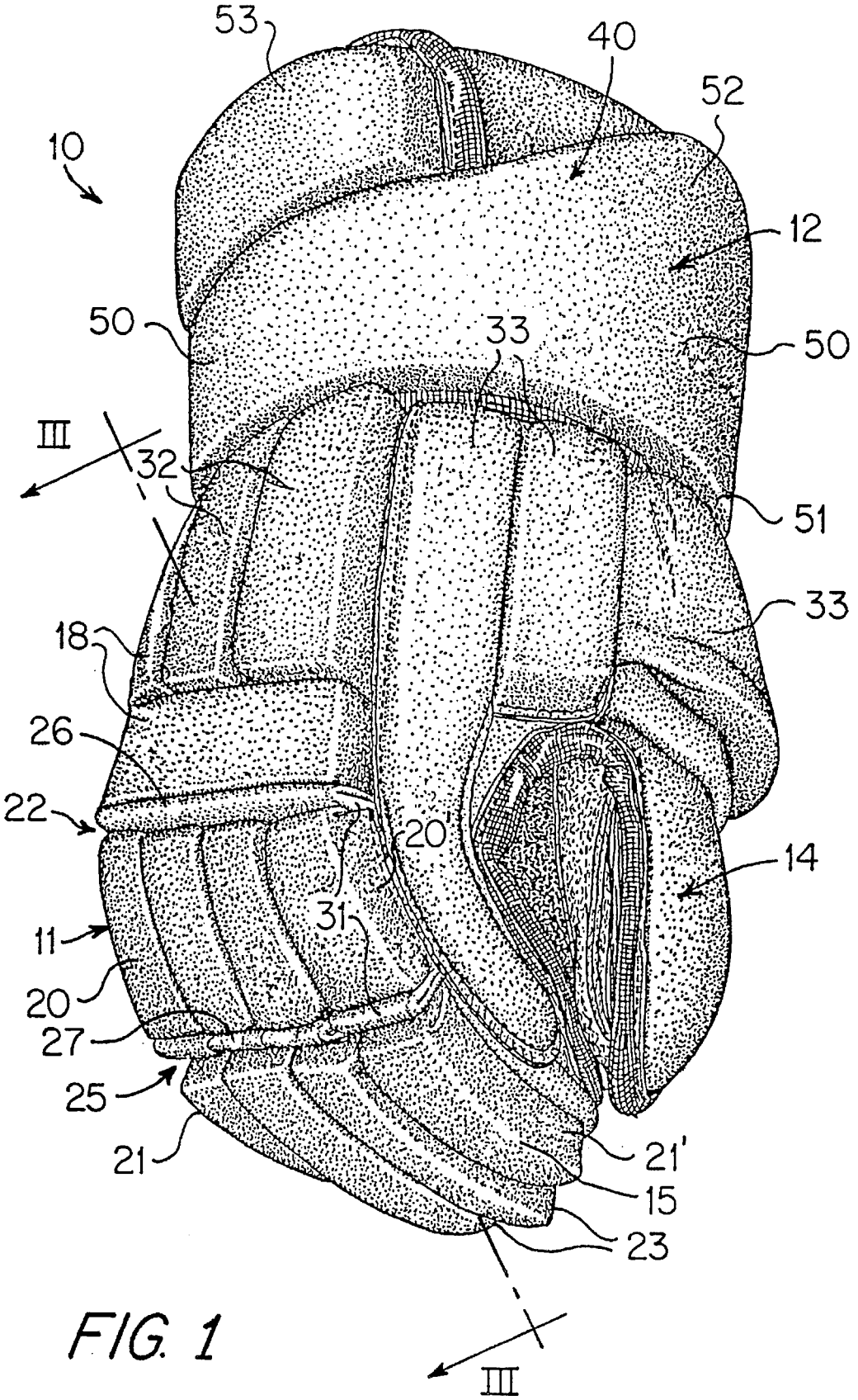
FIG. 1 is a perspective view of the hockey glove constructed in accordance with the present invention.
Figure 2:
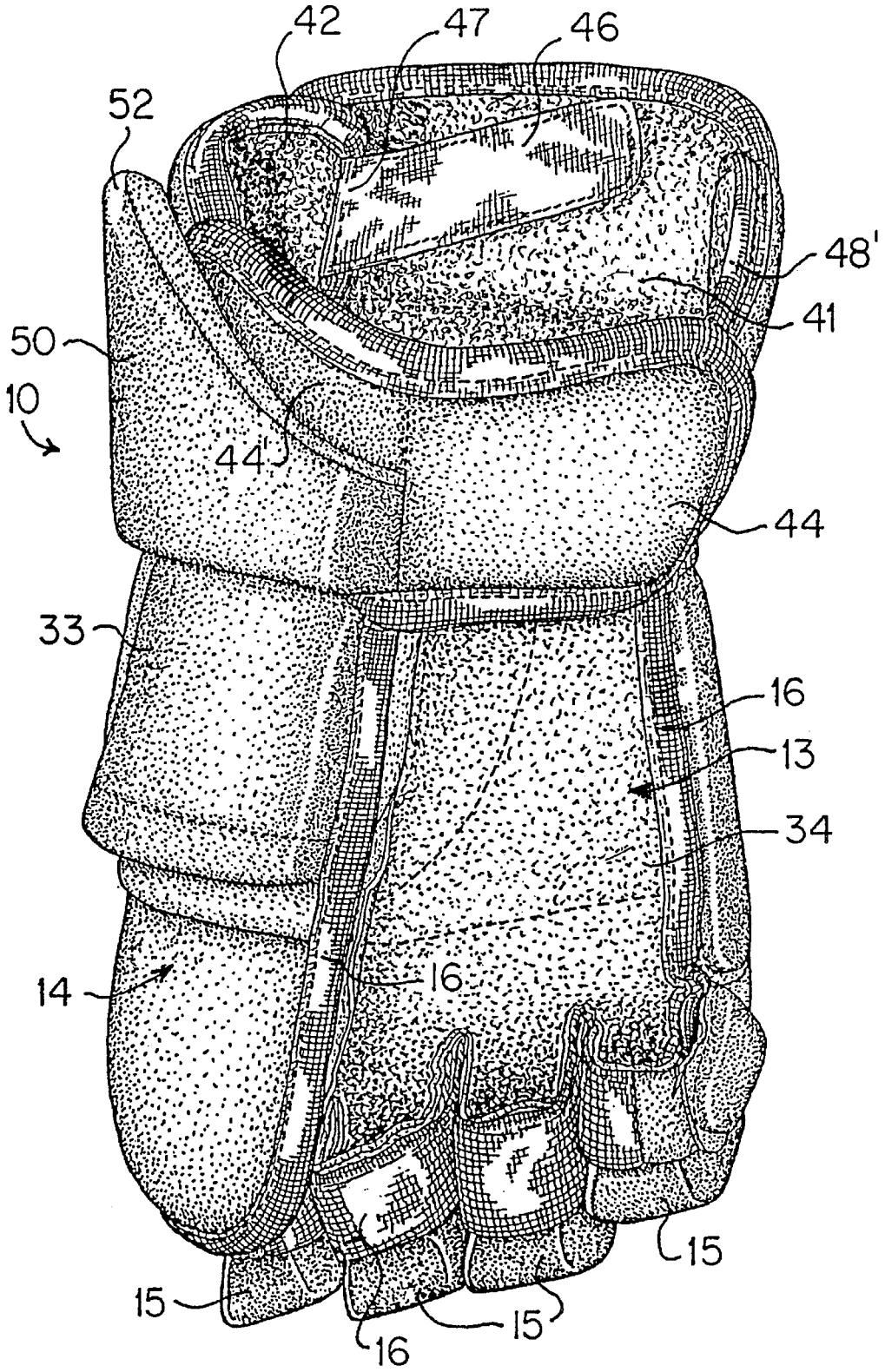
FIG. 2 is a rear view of the hockey glove of FIG. 1.

Referring now to the drawings, and more particularly to FIGS. 1 and 2, there is shown generally at 10 a hockey glove constructed in accordance with the present invention. The glove 10 comprises a hand protective section 11 and a wrist protective section 12. The hand protective section 11 includes a palm section 13, a thumb portion 14 and finger portions 15 all interconnected by an inner fabric 16 of flexible material.

Figure 3:
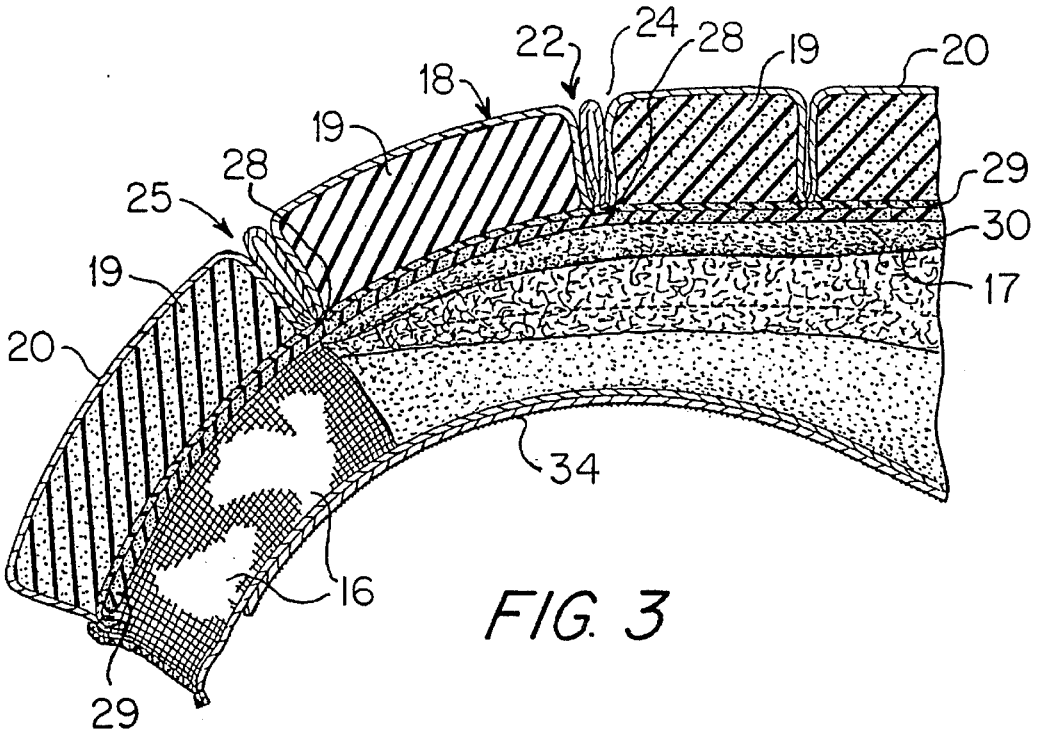
FIG. 3 is a fragmented section view, along section lines III—III of FIG. 1, showing the construction of the finger portions as well as a section of the hand portion.

An outer end protective fabric structure 17 is shown in the cross-section view of FIG. 3, and is connected to the inner fabric 16 and extends on a top part of the glove with a plurality of outer protective padded formations 18 connected thereto, as more clearly shown in FIG. 3. These outer protective padded formations 18 are disposed over the outer hand protective fabric structure 17. The padded formations 18 are formed by protective foam blocks 19, or similar shock absorbing materials capable of retaining their shape after impact, and having an outer wear resistant material covering, such as leather 20.

Figure 4:
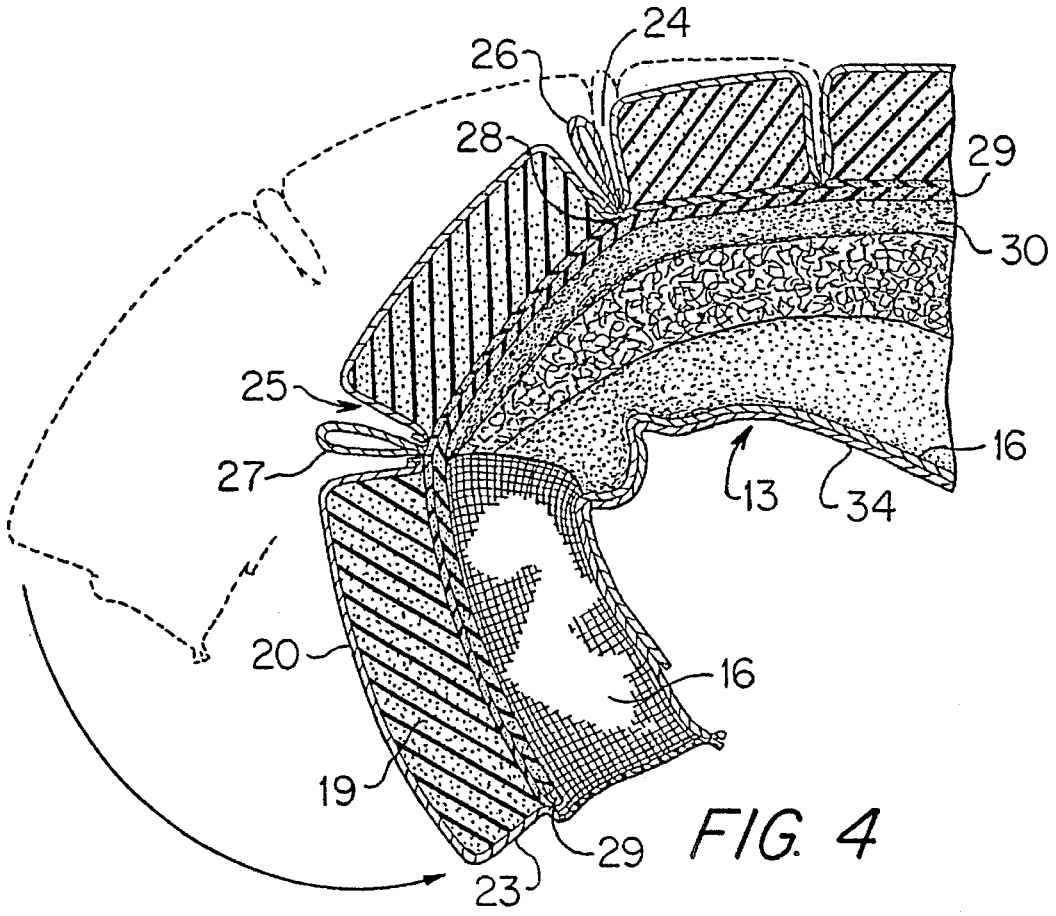
FIG. 4 is a section view, similar to FIG. 3, but showing the hockey glove in a clasped position.
Figure 5:
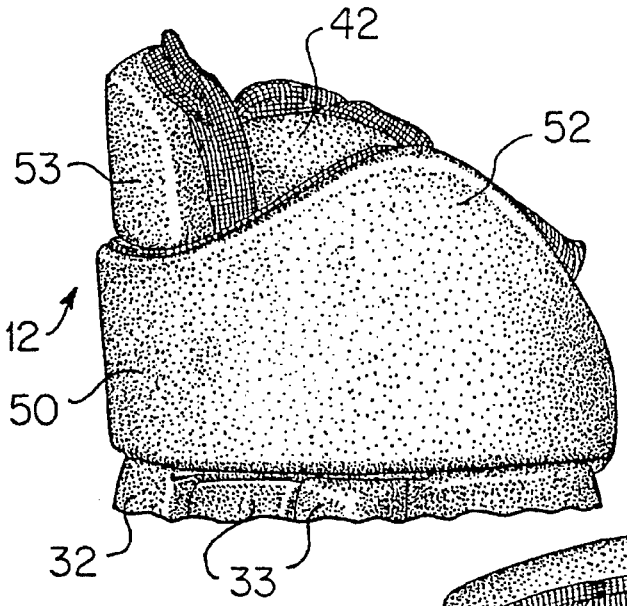
FIG. 5 is a segmented side view of the cuff portion of the hockey glove.

Referring to FIGS. 1, 3 and 4, it can be seen that the finger portions 15 have at least two separated padded finger sections 20 and 21 extending coextensively on top of each finger portion 15 from an upper knuckle area 22 of the finger portions to a finger ending 23.

A flexible joint 24 is defined at the upper knuckle area 22 and between the two separated padded finger sections 20 and 21, namely at 25 which is located substantially at a mid-knuckle area of finger portions 15. The joints are of predetermined spacing to permit ease of articulation between the padded finger sections 20 and 21.

A narrow transverse flexible protective web 26 of wear resistant material, herein leather, is secured across the finger portions in the flexible joint 24 while shorter transverse flexible protective webs 27, also of leather material, is secured in the joint areas between each of the finger sections 20 and 21.

These flexible webs are formed by flat loops of rectangular strips of leather which are stitched at a bottom end 28 to the top fabric layer 29 of the outer hand fabric structure 17. As herein shown, a padded fabric is also sewn to the underface of the upper fabric 29 to offer extra protection on top of the hand and for comfort of the wearer. The flexible protective webs 26 and 27 may also be sewn at their outer edges 31.

Referring now more specifically to FIGS. 3 and 4, it can be seen that when a wearer clasps his hand when wearing the glove, the joints 24 and 25 will open and the webs 26 and 27 will then offer protection in the open joint areas by collapsing therein if subjected to impact. The webs 26 and 27 would then reassume its original flap shape after clasping the hand a few times due to the restoring force of the looped leather to fill the space defined by the joint. The webs also permit the glove to assume a normal position of rest, as shown in FIG. 3. Accordingly, with these padded finger formations more flexibility is provided for finger movement to the wearer, providing easier hand movement to clasp a hockey stick or grasp other objects, while at the same time providing outer protection in the joint or knuckle areas. The provision of these joints reduces pressure points in the hand portion 11 of the glove as the only resistance to the clasping of the hand is offered by the upper fabric structure 29, which is minimal.

As herein shown, the padded finger sections 20 and 21 are of substantially square cross-sections, although these can also have a rounded upper shape. The glove 10 is further provided with a plurality of padded formations 32 disposed over the upper area of the hand portion 11 above the finger sections. Further padded formations 33 are also provided between the upper end portion which extend between an outer one of the finger sections, namely section 20' and 21', and the thumb portion 14 to the upper side of the hand.

With particular reference now to Figs, 2, 3 and 4, there is shown a layer of aramid material 34, particular Kevlar, sewn or otherwise secured over the palm, finger and thumb portions of the inner fabric 16 to provide increased wear resistance in this area. The Kevlar material also has an outer brushed rugged finish to enhance gripping of objects, such as a hockey stick (not shown) by a wearer.

Referring now more specifically to FIGS. 1, 2 and 5 to 7, there will be described the construction and operation of the wrist protection section 12. The wrist protective section 12 comprises an outer cuff structure 40 formed of substantially rigid padded material disposed in an upper part of the glove about a hand opening 41 of the glove. An adjustable inner cuff portion 42 is disposed inside the hand opening 41 of the outer cuff structure 40 and formed by one or more, herein two, interconnected flexible pads 43 and 44. Flexible pad 43 is a displaceable pad which is connected along an edge 45 thereof to a further pad 44 which is wholly or partly secured to an inner face of the cuff. Adjustable means in the form of a band 46 of hook and loop fabric, particulary Velcro, is secured at a free end 47 of the flexible pad 43 removably and adjustably connectable to an inner face 48 of at least a portion of the outer cuff structure 40 to vary the size of the hand opening 41 in the inner wrist area of the glove. The Velcro band 46 is formed with an engaging fiber structure, as is well known in the art, and the inner face 48 of the cuff or cuff members has an engageable outer fiber structure.

The outer cuff structure 40 is formed by a major transversely extending narrow rigid padded band 50 which extends across a top edge 51 of the thumb portion 14 and across the padded formations 32 of the hand portion. The padded band 50 has an upwardly sloping area which forms an elevated crest 52 at the juncture of the hand and thumb portions to provide added protection to a forward region of the wrist. An additional outer flexible pad 53 is secured above the narrow band 50 above the hand portion to provide protection on top of the wrist. A further flexible inner pad 48 is disposed behind the narrow band 50 and connects to a pad extension portion 44' of the inner flexible pad 44. The extension portion 44' is freely displaceable behind the wrist where minimal protection is required and where maximum flexibility is desired.

Figure 6:
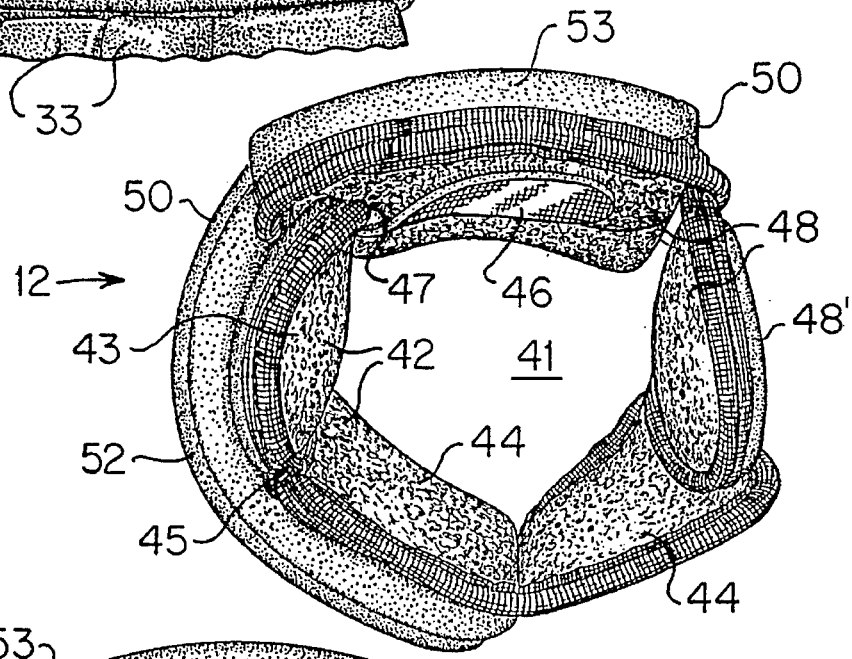
FIG. 6 is a top view of FIG. 5.
Figure 7:
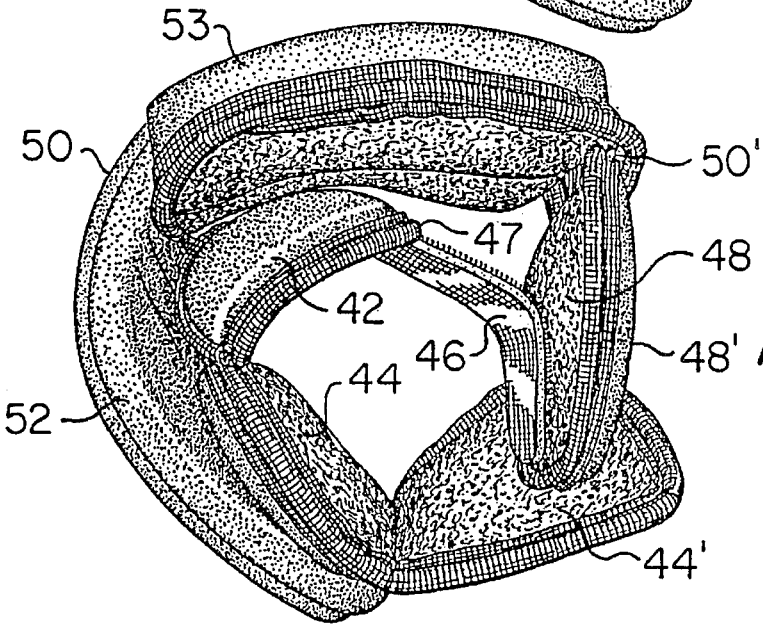
FIG. 7 is a top view, similar to FIG. 6, but showing the inner cuff adjusted to restrict the size of the hand opening of the glove.

Referring to FIGS. 6 and 7 there is shown the operation of the adjustable inner cuff portion. If the user of the glove wishes to have freer articulation of the wrist, then, the glove opening should have a wider opening about the wrist. For this maximum opening the Velcro band 46 is adjusted so that the pads 42 and 44 are substantially at a position as shown in FIG. 6. This is desirable to a hockey player who plays the position of center where, during a "face-off", one of his arms is bent at the elbow causing the wrist to also bend thereby requiring more freedom of movement for that arm. The other glove, on his other hand, may be cuffed differently so that the glove is maintained snug about his wrist. This provides less glove movement and substantially eliminates the possibility of the glove becoming loose and falling off his hand during collision, etc. It also maintains the cuff in a snug position about the wrist enhancing the protection that the glove is intended to offer. The Velcro band 46 also provides ease of adjustment for hands and wrists of different sizes by permiting a variety of incremental adjustments.

An advantage of the outer cuff portion structure 40 is that the pads, such as pads 50 and 53, do not need to be constructed of rigid material, particularly the inner pad structure 42, 44 and 48 disposed about the wrist section. Heretofore hockey gloves have been constructed with at least part of the cuff structure being formed of rigid plastic material and this offers discomfort to the wearer and can also cause injury if the plastic is broken. With the wrist structure of the present invention the entire inner cuff structure is constructed of flexible pads. This is also true of the rear portion of the external cuff structure. The rigid padded bands 50 and 53 are provided in the forward and top part of the hand and wrist areas. The elevated crest 52 provides added protection to the wearer when the inner cuff is in a fully open position as shown in FIG. 6. It is also pointed out that because the inner Kevlar layer 34 has a brushed surface, it provides added friction and better gripping with the hockey stick thereby having a better grip thereon during use and when it is necessary to pick the stick off a playing surface.

It is within the ambit of the present invention to cover any obvious modifications of the preferred example described herein, provided such modifications fall within the scope of the appended claims.

I claim:

1. A hockey glove comprising a hand protective section and a wrist protective section; said hand protective section having a palm portion, a thumb portion and finger portions interconnected by an inner fabric; an outer hand protective fabric structure connected to said inner fabric and having a plurality of outer protective padded formations disposed over said hand protective fabric structure, thumb portion and finger portions; said padded formations having an outer wear resistant material cover, said padded formation disposed over each said finger portion having at least two separated padded finger sections extending coextensively with each finger portion from an upper knuckle area of said finger portions to a finger ending, a flexible joint defined at said upper knuckle area and between said two separated padded finger sections substantially at a mid-knuckle area of said finger portion, and a narrow transverse flexible protective web of wear resistant material secured in said joint areas to provide external protection at said joint areas when said finger portions are articulated to a clasped position by a wearer, said joints reducing pressure points in said hand protective section when a wearer's hand is clasped such as when gripping a hockey stick.

2. A hockey glove as claimed in claim 1 wherein said flexible protective web is a flat loop formed from a strip of said wear resistant material and secured to said outer hand protective fabric in said joint areas.

3. A hockey glove as claimed in claim 2 wherein said joint defined at said upper knuckle area is a single elongated joint defining a space of predetermined width extending across said finger portions.

4. A hockey glove as claimed in claim 2 wherein said wear resistant material is leather.

5. A hockey glove as claimed in claim 1 wherein said outer wear resistant material covering is leather.

6. A hockey glove as claimed in claim 1 wherein said padded formation of said padded finger sections is a foam material capable of retaining its shape after receiving an impact force.

7. A hockey glove as claimed in claim 6 wherein there is provided a plurality of said padded formations disposed over said hand portion, a further padded formation secured between said hand and an outer one of said finger portions and said thumb portion.

8. A hockey glove as claimed in claim 1 wherein there is further provided an external layer of aramid material secured over said palm, finger and thumb portions of said inner fabric to provide increased wear resistance.

9. A hockey glove as claimed in claim 8 wherein said aramid material has an outer brushed rugged finish to enhance gripping of an object by a wearer.

10. A hockey glove as claimed in claim 1 wherein said wrist protective section comprises an outer cuff structure formed of substantially rigid padded material disposed about at least a forward portion of a hand opening of said glove, and an adjustable inner cuff portion disposed inside said hand opening adjacent said outer cuff portion and formed by one or more interconnected flexible pads, and adjustable means secured to a free end of one of said flexible pads and removably connectable to an inner face of at least a portion of said outer cuff structure to vary the size of said hand opening in an inner wrist area of said glove.

11. A hockey glove as claimed in claim 10 wherein said adjustable means is a band of hook and loop fabric secured at a free end of an outer one of said flexible pads, said inner face of at least a portion of said outer cuff having a hook and loop fabric for engagement with said hook and loop fabric of said band, one of said hook and loop fabrics having engaging fibers and the other having engageable fibers.

12. A hockey glove as claimed in claim 10 wherein there is provided a single one of said inner flexible pads, said single pad being stitched at one side to said inner face of said outer cuff and having said band secured to an opposed free end of said single pad.

13. A hockey glove as claimed in claim 10 wherein said outer cuff structure has a major transversely extending narrow rigid padded band extending across a top edge of said thumb portion and across said hand portion, said padded band sloping upwardly to form an elevated crest at a juncture of said hand and thumb portions, and an upper transverse narrow rigid padded band immediately above said major padded band and extending across said hand portion.

14. A hockey glove as claimed in claim 13 wherein there is further provided additional outer flexible pads secured between opposed free ends of said major padded band, one of said additional outer flexible pads extending behind said thumb portion and having a detached flexible section connected to said single one of said inner flexible pad.

15. A hockey glove comprising a hand protective section and a wrist protective section; said hand protective section having a palm portion, a thumb portion and finger portions interconnected by an inner flexible fabric; an outer hand protective fabric structure connected to said inner flexible fabric and having a plurality of outer protective padded formations disposed over said hand protective fabric structure, thumb portion and finger portions; said padded formations having an outer wear resistant material cover, said wrist protective section having an outer cuff structure formed of substantially rigid padded material disposed about at least a forward portion of a hand opening of said glove, and an adjustable inner cuff portion disposed inside said hand opening adjacent said outer cuff portion and formed by one or more interconnected flexible pads, and adjustable means secured to a free end of one of said flexible pads and removably connectable to an inner face of at least a portion of said outer cuff structure to vary the size of said hand opening in an inner wrist area of said glove.

16. A hockey glove as claimed in claim 15 wherein said adjustable means is a band of hook and loop fabric secured at a free end of an outer one of said flexible pads, said inner face of at least a portion of said outer cuff having a hook and loop fabric for engagement with said hook and loop fabric of said band, one of said hook and loop fabric having engaging fibers and the other having engageable fibers.

17. A hockey glove as claimed in claim 15 wherein there is provided a single one of said inner flexible pads, said single pad being stitched at one side to said inner face of said outer cuff and having said band secured to an opposed side of said single pad.

18. A hockey glove as claimed in claim 15 wherein said outer cuff structure has a major transversely extending narrow rigid padded band extending across a top edge of said thumb portion and across said hand portion, said padded band sloping upwardly to form an elevated crest at a juncture of said hand and thumb portions, and an upper transverse narrow rigid padded band immediately above said major padded band and extending across said hand portion.

19. A hockey glove as claimed in claim 18 wherein there is further provided additional outer flexible pads secured between opposed free ends of said major padded band, one of said additional outer flexible pads extending behind said thumb portion and having a detached flexible section connected to said single one of said inner flexible pad.

20. A hockey glove as claimed in claim 15 wherein there is further provided a layer of aramid material secured over said palm, finger and thumb portions of said inner fabric to provide increased wear resistance.

21. A hockey glove as claimed in claim 20 wherein said aramid material has an outer brushed rugged finish to enhance gripping of an object by a wearer.

* * * * *